US006328284B2

(12) United States Patent
Wilding

(10) Patent No.: US 6,328,284 B2
(45) **Date of Patent: *Dec. 11, 2001**

(54) ROADWAY GUARDRAIL COVER

(76) Inventor: James J. Wilding, 378 Oaklawn Dr., Pittsburgh, PA (US) 15241

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/252,505

(22) Filed: Feb. 18, 1999

(51) Int. Cl.[7] ..... E01F 15/00
(52) U.S. Cl. ..... 256/13.1; 256/1; 256/19
(58) Field of Search ..... 256/13.1, 1, 19; 40/599, 658, 666, 612, 611

(56) References Cited

U.S. PATENT DOCUMENTS 3,861,110 * 1/1975 Bartlett .
4,222,552 * 9/1980 Matteo, Sr. ..... 256/13.1
4,723,758 2/1988 Gehrig ..... 256/13.1
4,907,783 * 3/1990 Fisk et al. .
5,029,819 * 7/1991 Kane .
5,299,883 * 4/1994 Arth, Jr. .
5,458,942 * 10/1995 Miller ..... 256/19

* cited by examiner

*Primary Examiner*—Lynne H. Browne
*Assistant Examiner*—Tomlyne A Malcolm
(74) *Attorney, Agent, or Firm*—Carothers & Carothers

(57) ABSTRACT

A guardrail covering which mounts onto elongated roadway metal rail segments of a guardrail which usually have a generally W-shaped side face and the metal segments are secured between upright posts. The guardrail covering of the present invention is an inverted generally U-shaped resilient and elongated channel member that is dimensioned to fit downwardly over a guardrail segment to provide beautification and available space for signage.

6 Claims, 2 Drawing Sheets

ROADWAY GUARDRAIL COVER

BACKGROUND OF THE INVENTION

The Present invention generally relates to devices for covering or enclosing elongated rail structures. More particularly, the invention is directed to a cover for enclosing and beautifying metal highway guardrails while simultaneously enhancing visibility and providing available signage or advertising space.

Guardrails which are presently installed along roadways or highways are typically comprised of horizontal elongated metal guardrail sections that are supported at spaced intervals by a plurality of upright or vertical posts anchored into the ground. The guardrail sections are generally joined in an end-to-end relationship either at the post or intermediate the post with splices. The guardrail sections are generally fastened to the vertical posts by bolting, riveting or similar fasteners.

The metal guardrails are generally constructed of galvanized steel, but are nevertheless still subject to rapid deterioration because of constant exposure to rain, moisture and more particularly road salt. In addition, the guardrails become very unsightly, not only due to rusting and corrosion, but also due to dents, bends and other damage caused by parking vehicles accidentally engaging the guardrail, by debris thrown into the guardrail by passing vehicles and by engagement with snow plows etc.

A major problem encountered with resilient covers of the prior art for guardrails is that they cannot and will not readily be secured to damaged rail segments which are bent and dented.

It is a principal object of the present invention to provide an improved highway guardrail cover that is quickly and easily attached to an existing guardrail, provides an attractive corrosion resistant surface and also permits easy application of signage or advertising. The cover of the present invention may also provide safety reflective surfaces and safety notice indicia indicating road hazzards and facility identification.

SUMMARY OF THE INVENTION

The guardrail covering of the present invention is generally provided for mounting to elongated roadway metal rail segments that usually have a generally W-shaped side face and these segments are secured between upright posts anchored into the ground. The guardrail covering is provided in the form of an inverted generally U-shaped resilient and elongated channel member that is dimensioned to fit downwardly over a guardrail segment.

No additional securement of the covering to the guardrail is required, however, fasteners may be additionally provided if desired for securing the channel member on the guardrail segment.

For such additional securement, the bottom edges of the channel member may extend below the covered rail segment and the fasteners may be provided in the form of spaced bolts securing these bottom edges together underneath the rail segment.

Another means of fastening the channel member to the rail segments is to provide tabs on a bottom edge of the channel member which protrude inwardly for engaging a bottom edge of the covered rail segment.

The resilient covering not only provides a protective and attractive appearance, but may also be utilized for displaying signage indicia to provide information to address a drivers attention to entries, exits, directional situations, dangerous road conditions, facility identification, etc. The signage indicia may also be in the form of product advertising. The covering may be provided with safety light reflective properties.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF A PREFERRED EMBODIMENT

Figure 2:
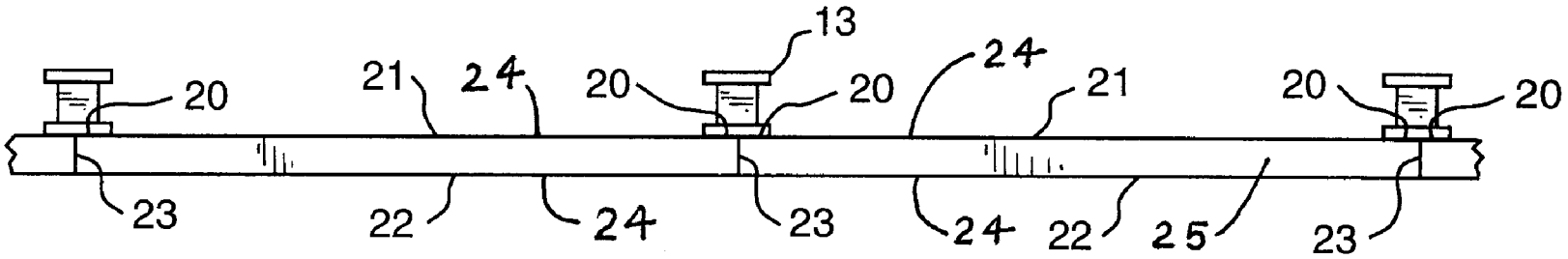
FIG. 2 is a plan view of the covered guardrail section shown in FIG. 1.

Referring to the drawings, a metal guardrail 10 is illustrated which is made up of elongated metal rail segments 11 which have general W-shaped side faces 12 and a top edge 26 and the segments 11 are secured between upright posts 13 with bolts 14. The posts 13 are anchored into the ground 19 adjacent a roadway.

Figure 3:
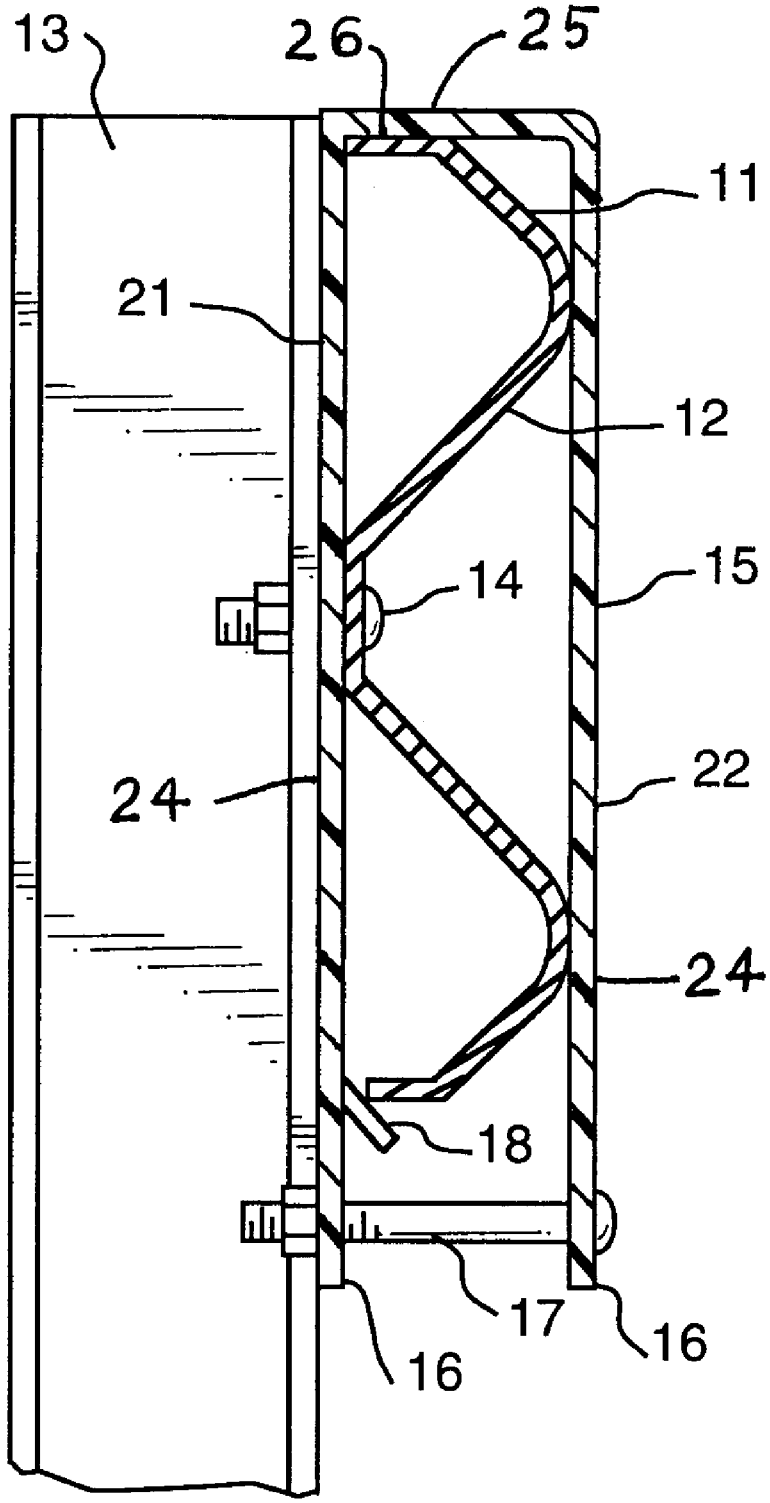
FIG. 3 is a view in vertical cross section of the covered guardrail shown in FIG. 1 as seen along section line III—III.

The guardrail coverings 15 of the present invention have vertical opposing side panels 24 and a narrower top panel 25, and are configured as inverted generally U-shaped resilient and elongated channel members which are dimensioned to fit downwardly over a damaged and corrugated guardrail segment 11 as is best illustrated in FIG. 3.

Figure 1:
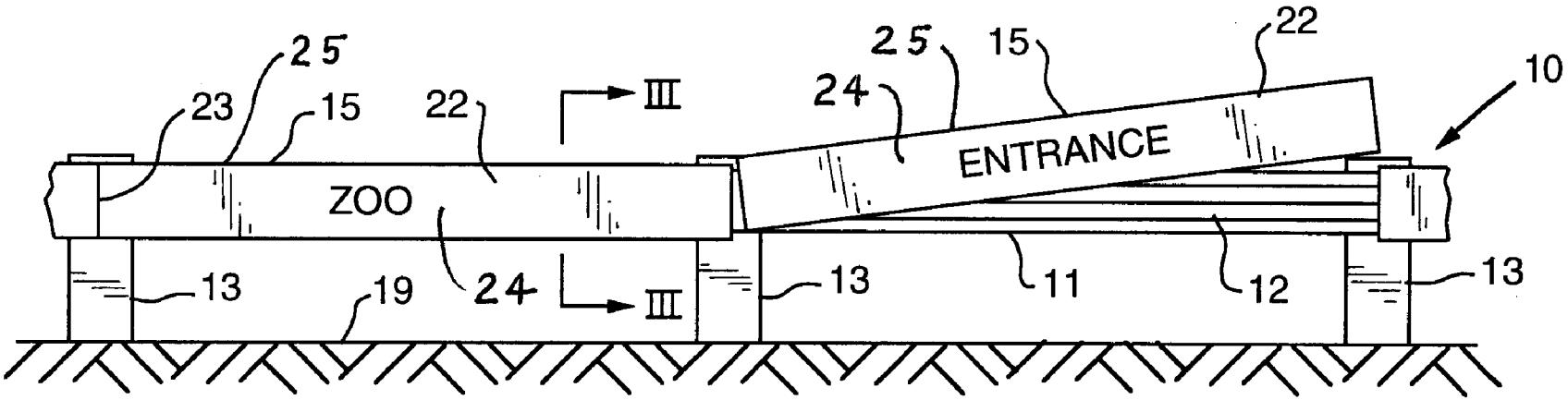
FIG. 1 is a view in side elevation illustrating the guardrail covering of the present invention as mounted on segments of highway guardrail.

FIG. 1 illustrates two side by side channel members 15 wherein the one shown on the left hand side of the figure is fully received over its respective guardrail and the one shown at the right hand side of the figure is in the process of being applied to the underlying guardrail segment 11.

The elongated channel members 15 are preferably molded of a resilient material such as plastic which will not dent or they may also be formed of a metal such as aluminum. In addition, they may be provided in any color desired and they may also provide with any appropriate logos, signage or indicia as desired and as illustrated by way of example in FIG. 1.

Fasteners may also be provided for securing the channel members 15 onto the rail segments 11 as desired. For example, as is best illustrated in FIG. 3, the bottom edges 16 of channel member 15 extend below the covered guardrail segment 11 and spaced bolts 17 are provided for securing these bottom edges together.

As an alternative, the fastener may include tabs 18 on the bottom inside edge 16 of channel member 15 which protrude inwardly as illustrated in FIG. 3 for engaging a bottom edge of rail segment 11. The flexible nature of the channel member 15 and the tabs 18 are such that tabs 18 and the side walls of channel member 15 may be spread to a install or uninstalled channel member 15.

As is best illustrated in the top view shown in FIG. 2, the opposite ends of the channel members 15 are provided with cutouts 20 on their back faces 21 which are dimensioned for clearing the support posts 13 so that adjacent channel members 15 may abut snugly up against each other on their front faces 22 at seams 23 as illustrated to provide a smooth continuous surface.

I claim:

1. A combination guardrail and guardrail covering therefor, said combination comprising: a guardrail having elongated roadway metal rail segments with each usually having generally W-shaped vertical front and back side faces and top and bottom edges narrower than said side faces and secured between spaced upright posts; and an inverted generally U-shaped resilient and elongated channel member having vertical opposing side panels and a top panel and dimensioned to fit downwardly over both sides of a single W-shaped guardrail segment whereby said vertical side faces and top edge are fully covered respectively by said vertical opposing side panels and said top panel.

2. The combination guardrail and guardrail covering of claim 1 including fasteners for securing said channel member on a rail segment.

3. The combination guardrail and guardrail covering of claim 2 wherein bottom edges of said channel member extend below a covered rail segment and said fasteners include spaced bolts securing said bottom edges together.

4. The combination guardrail and guardrail covering of claim 2 wherein said fastener includes tabs on a bottom edge of said channel member which protrude inwardly for engaging a bottom edge of a covered rail segment.

5. The combination guardrail and guardrail covering of claim 1 including signage on a side face of said channel member.

6. The combination guardrail and guardrail covering of claim 1, said channel members having cut-outs on opposite ends thereof dimensioned for clearing support posts supporting a covered guardrail segment.

* * * * *